United States Patent [19]

Tjornhom, Sr.

[11] 4,093,333

[45] June 6, 1978

[54] ELECTRICAL ADAPTER

[76] Inventor: David A. Tjornhom, Sr., 2895 West Rd., Wayzata, Minn. 55391

[21] Appl. No.: 640,937

[22] Filed: Dec. 15, 1975

Related U.S. Application Data

[63] Continuation-in-part of Ser. No. 500,610, Aug. 26, 1974, abandoned.

[51] Int. Cl.[2] ..... H01R 17/20; H01R 31/06

[52] U.S. Cl. ..... 339/78; 339/84; 339/154 L

[58] Field of Search ..... 339/153, 154 AL, 76–79, 339/82–86, 81, 161

[56] References Cited

U.S. PATENT DOCUMENTS

| | | | |
|---|---|---|---|
| 348,647 | 9/1886 | Weston | 339/154.6 |
| 794,458 | 7/1905 | Gollatz | 339/153 |
| 1,034,151 | 7/1912 | Silbert | 339/78 |
| 1,082,397 | 12/1913 | Blass | 339/84 |
| 1,540,174 | 6/1925 | Mallett | 339/199 R |
| 1,572,906 | 2/1926 | Strongson | 339/161 |
| 1,621,341 | 3/1927 | Vogt | 339/78 |
| 1,648,916 | 11/1927 | Schmidt, Jr. | 339/81 |
| 1,675,353 | 7/1928 | Kellner | 339/77 |
| 2,129,379 | 9/1938 | Mollan | 339/84 |
| 2,194,329 | 3/1940 | Sokoloff | 339/77 |

FOREIGN PATENT DOCUMENTS

| | | | |
|---|---|---|---|
| 490,199 | 1/1930 | Germany | 339/152 |

OTHER PUBLICATIONS

Gold, Live & Learn Dept., The Washington Post, 8/2/66, pp. B10, 339–382.

*Primary Examiner*—Neil Abrams
*Attorney, Agent, or Firm*—Burd, Braddock & Bartz

[57] ABSTRACT

An adapter for a conventional threaded electric light socket or the like having an external right hand threaded base for threading into a conventional socket. A locking tab on the base permits the adapter to be threaded into the socket and jams the threads of the socket to prevent its removal. The adapter has a cavity with an internal left hand thread for receiving an unconventional bulb or the like with a mating left hand threaded base. In one form, the adapter has a releasable lock structure for holding the adapter in the socket. A removal tool is used to release the lock structure to permit the adapter to be turned into and out of the socket.

11 Claims, 16 Drawing Figures

ELECTRICAL ADAPTER

CROSS REFERENCE TO RELATED APPLICATION

This application is a continuation-in-part of U.S. application Ser. No. 500,610 filed Aug. 26, 1974 now abandoned.

BACKGROUND OF INVENTION

The conventional incandescent light bulb has an external right hand threaded base and is threaded into a mating socket. The bulb can be removed by simply reversing it or screwing it out of the socket. This type of bulb and socket is so universally used that a bulb removed from one socket can be used in almost any other socket anywhere.

In many places the theft of light bulbs is a substantial and continuing problem. This is especially true in hotels, motels, apartment buildings and the like. The cost of replacing stolen bulbs is often substantial, including both the cost of bulbs and labor for replacing them. In addition, the theft of a bulb may result in a hazardous condition for customers, tenants or guests where a bulb is removed over a stairway or near some obstacle. At best, a stolen bulb results in an inconvenience. There is a longstanding need for a simple and inexpensive way to deter stealing of bulbs.

SUMMARY OF INVENTION

This invention provides a simple and relatively inexpensive means for discouraging and deterring stealing of electric light bulbs and the like. It includes an adapter with an external right hand threaded base portion adapted to be threaded into a conventional mating socket. Locking means are used to lock the adapter in the socket. In one form of the adapter, the locking means can be released with an adapter mounting and removing apparatus so that the adapter can be turned into and out of the socket. The adapter has a cavity and fastening means, dissimilar from the right hand threaded fastening means in a conventional socket, for receiving and fastening an electric light bulb or the like having a mating base and fastening means. In a preferred form, the fastening means comprises an internal left hand threaded portion in the cavity in the adapter for receiving a bulb with a mating left hand threaded base. The right hand threaded base portion and the internal left hand threaded portion are formed in spaced, coaxial relationship on a single electrically conductive member. The body of the adapter can be an electrically insulative material. An electrical conductor in the form of a strip mounted on the body and open to the internal and external threaded portions provides an electrical connection between the base of the light bulb and the socket. The invention provides an adapter usable in a conventional socket and which locks therein to effectively prevent its removal and the adapter provides a socket for a bulb with an unconventional base, which bulb gives the initial impression of not being removable and is not readily usable in a conventional socket so persons will not be likely to steal it.

The invention is also directed to an apparatus for mounting and removing the adapter from the socket. The apparatus has a means operable to release the locking structure that holds the adapter in the socket. Once the locking structure has been released, the adapter can be removed from the socket.

An object of the invention is to provide a means and method of deterring or preventing the theft of light bulbs or the like from conventional electrical sockets. Another object is to provide means as aforesaid which is inexpensive and readily usable with conventional electric sockets. A further object is to provide an adapter with releasable lock structure usable in a conventional light socket to deter theft of the adapter. Yet another object of the invention is to provide a light bulb adapter for holding a left hand threaded light bulb and being mountable in and locked in a right hand threaded electrical fixture. A still further object of the invention is to provide an apparatus for mounting and removing an electric light bulb adapter from a socket of an electrical fixture. These and other objects and advantages of the invention will be set forth in detail in the following description made in connection with the accompanying drawing.

IN THE DRAWINGS

DESCRIPTION OF PREFERRED EMBODIMENT

Figure 1:
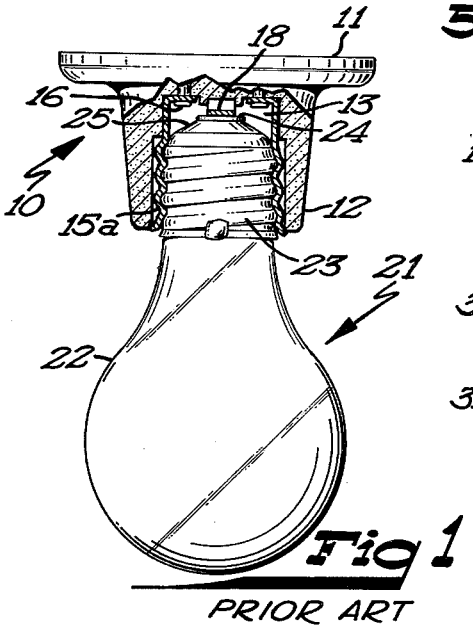
Fig 1 PRIOR ART
FIG. 1 is an elevational view, with portions broken away, of a conventional electric light socket and bulb.

Referring to the drawing, a preferred embodiment of the invention will be described. Reference numeral 10 refers to a conventional electric socket having a base 11 of porcelain or other insulative material. Base 11 includes a neck or extended portion 12 with an axial cavity 13 therein and a transverse web or seat 14 at the base of the cavity. Disposed in cavity 13 is a conductive member 15 providing an internal right hand threaded portion 15*a* and base members 15*b* which are secured to seat 14 by conductive rivets or pins 16. At the center of cavity 13, adjacent seat 14, is an electrical contact 18 which is secured to seat 14 by an electrically conductive member 20.

In FIG. 1 there is threaded into socket 10 a conventional light bulb 21 having a globe portion 22 of glass or the like and a base portion including a conductive right hand threaded portion 23 which mates with threaded portion 15*a* in the socket. An electrical contact 24 extends axially from the base of the bulb for engagement with contact 18 in the socket. Contact 24 is insulated from threaded portion 23 by an insulator portion 25 on the base of the bulb. The lamp filament (not shown) is electrically connected across in a conventional manner.

Socket 10 and bulb 21 are conventional. Conductive threaded portion 15*a* of the socket may be connected through pins 16 and appropriate conductors (not shown) to one side of a power supply (not shown). Similarly conductive member 20, and thereby contact 18, may be connected to the other side of the power supply. When bulb 21 is threaded into socket 10, a circuit is completed through mating conductive threaded portions 15*a* and 23 of socket 10 and bulb 21, respectively. Contacts 18 and 24 engage and provide a second conductive path.

Bulb 21 can be readily removed from socket 10 by simply backing it or screwing it out of the socket. This makes replacement of burned out bulbs simple but also makes it possible and easy for unauthorized persons to remove the bulb. Since this type of bulb and socket are conventional and in extensive use, a bulb taken from one socket is readily usable in most other sockets anywhere. Thus, many light bulbs are stolen.

Figure 2:
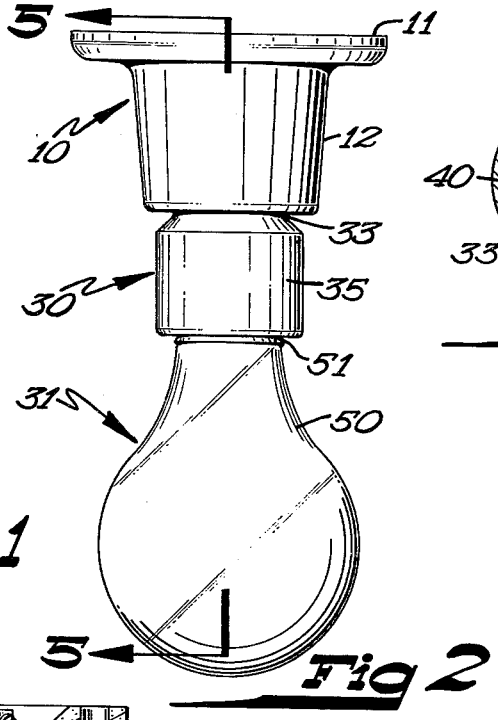
FIG. 2 is an elevational view of a conventional electric light socket fitted with the adapter of this invention and an unconventional light bulb which mates with the adapter.
Figure 4:
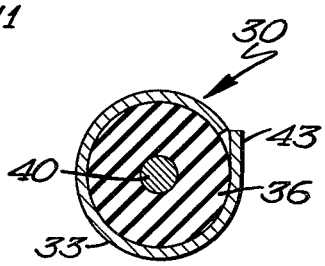
FIG. 4 is a transverse cross-sectional view taken along line 4—4 of FIG. 3.

FIG. 2 discloses the same socket 10 fitted with an adapter 30 which accepts an unconventional bulb 31 which has a dissimilar base and fastening means so it is not usable directly with a conventional socket.

Adapter 30 includes a tubular electrically conductive member 32 formed with an external right hand threaded portion 33 adapted to be threaded into a conventional socket like socket 10 described above. At the other end, member 32 is formed with an internal left hand threaded portion 34 providing a cavity to receive the base of bulb 31. The exterior of portion 34 is covered with an insulative material 35 of Bakelite or the like. Disposed axially in insulative material 36 is a conductor 40 which has a contact 41 on the top end of material 36 and a contact 42 on the other end of material 36 at the inner end of the cavity formed by threaded portion 34. Outwardly struck from threaded portion 34 is a tab 43. The material of member 32 has sufficient resiliency so that tab 43 is normally disposed with its free end outward from portion 33 but will yield so it will be depressed as adapter 30 is threaded into socket 10. Tab 43 is disposed so that it is integral with threaded portion 33 at its leading end as the adapter is threaded into the socket. The free end of tab 43 is continuously urged outward by its resilience. When the adapter is threaded into the socket so that tab 43 is within the threaded portion 15*a* of the socket, tab 43 does not substantially interfere with the turning of the adapter to advance it into the socket but the outer end of tab 43 jams with the threaded portion 15*a* when the adapter is rotated in a reverse direction. This locks the adapter in place to effectively prevent its removal.

Bulb 31 has a globe portion 50, a left hand threaded conductive base portion 51, a center contact 52 at the center of the base, and an insulative material 53 separating portion 51 and contact 52. A filament (not shown) is connected across portion 51 and contact 52 in the conventional manner. While the preferred form mating fastening means for bulb 31 and adapter 30 is the mating left hand threaded portions, other fastening means may be used but it is essential that they be dissimilar to the right hand threads which form the fastening means between the conventional socket and the adapter.

Adapter 30 is threaded into socket 10 so that contact 41 engages contact 18. Tab 43 is then disposed inside threaded portion 15*a* and locks the adapter in the socket. Mating threaded portion 33 on the adapter and portion 15*a* on the socket provide both a fastening means and a conductive path which extends through portion 34 of the adapter. Bulb 31 is threaded into adapter 30 and mating left hand threaded portions 34 and 51 of the adapter and bulb, respectively, also provide a fastening means and a conductive path. Contact 52 of bulb 31 engages contact 42 of the adapter so an electrical path is provided through contact 41, conductor 40, contact 42 and contact 52 to the filament of the bulb.

Figure 5:
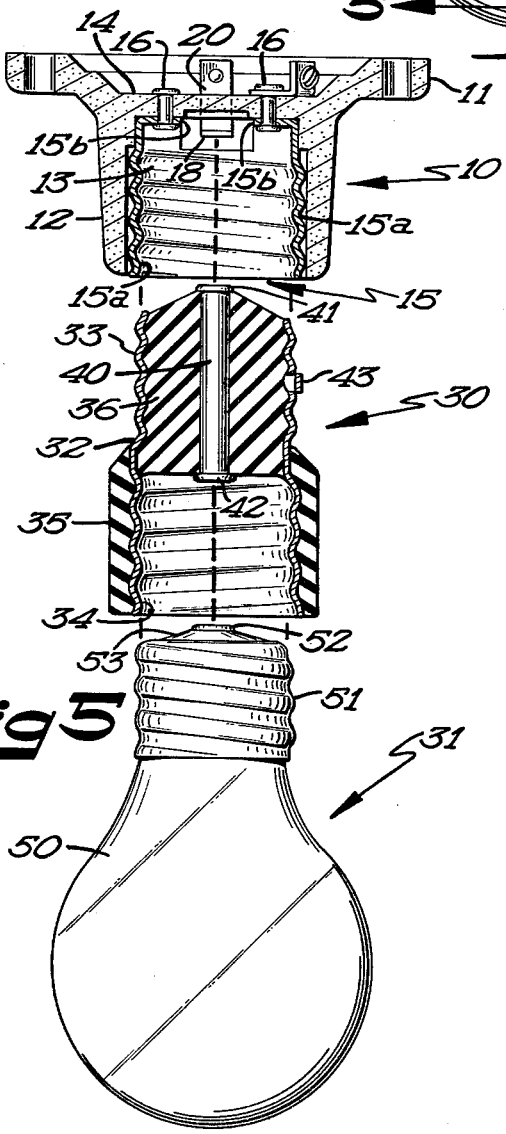
FIG. 5 is a longitudinal cross-sectional view of the socket, adapter and bulb taken along line 5—5 of FIG. 2, but differing from FIG. 2 in that it is exploded.
Figure 3:
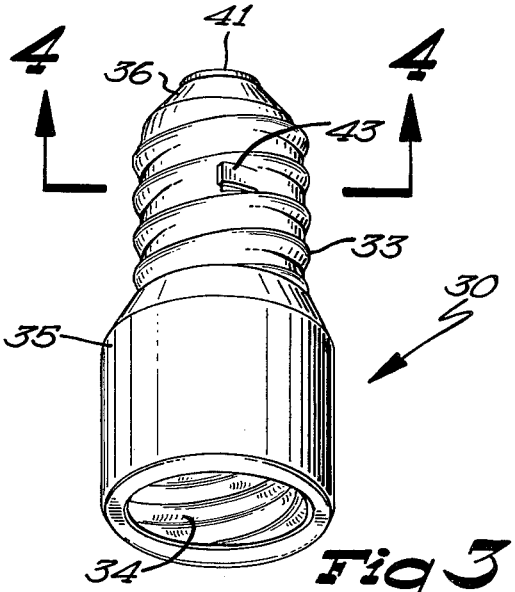
FIG. 3 is a perspective view, as seen from the bottom front, of the adapter.
Figure 6:
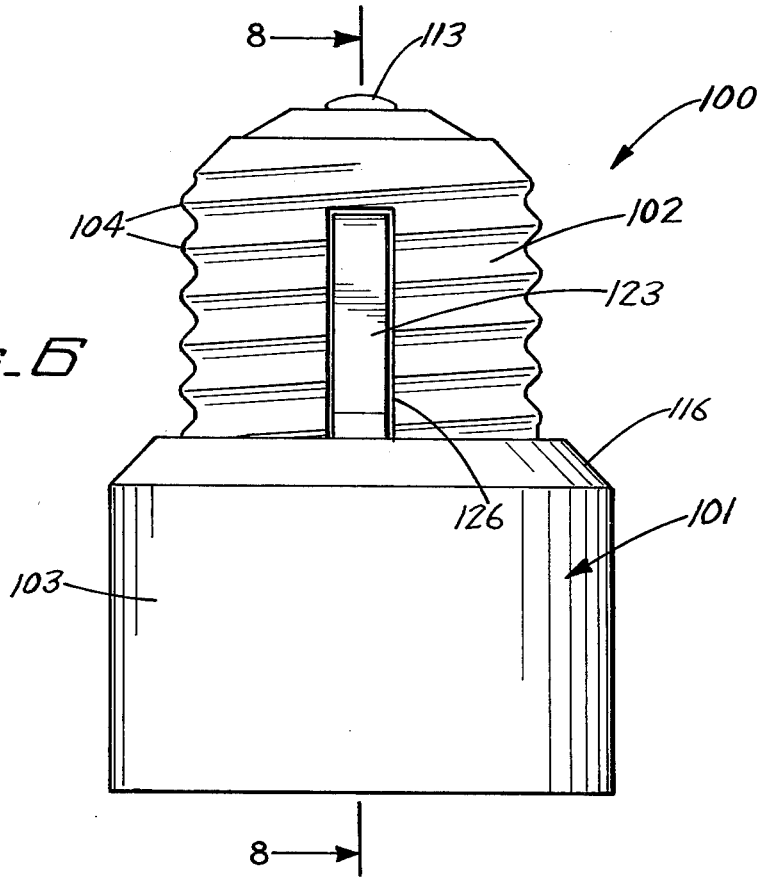
FIG. 6 is an elevational view of a modification of the adapter of the invention.
Figure 7:
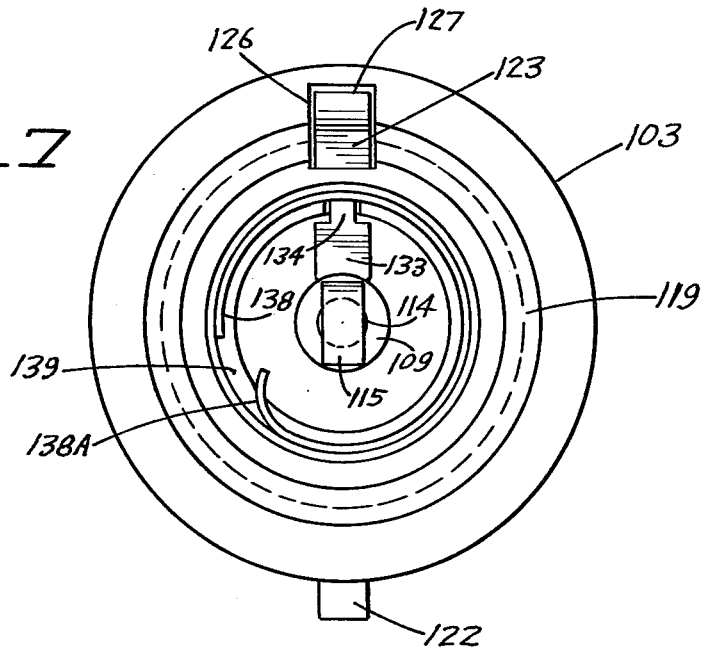
FIG. 7 is a plan view of the bottom of the adapter of FIG. 6.
Figure 8:
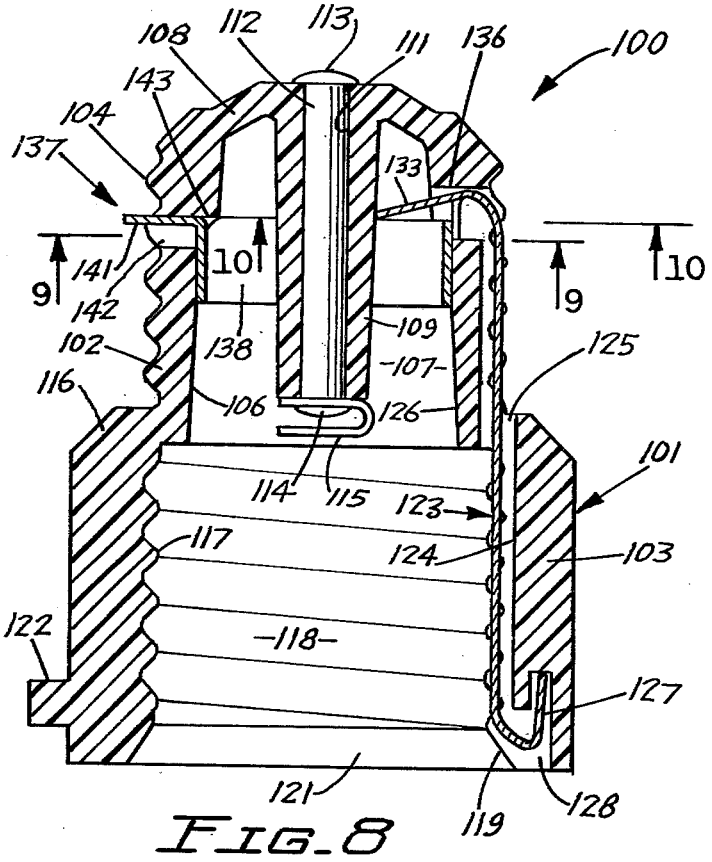
FIG. 8 is an enlarged sectional view taken along line 8—8 of FIG. 6.

Referring to FIGS. 6, 7 and 8, there is shown a modification of the electrical adapter of the invention indicated generally at 100. Adapter 100 has a tubular member or body 101 of electrically insulative material, such as a rigid plastic or the like. Body 101 has an external right hand threaded section or portion 102 and an internal left hand threaded section or portion 103. The right hand threaded portion 102 is adapted to be turned into a conventional right hand threaded socket, such as socket 10 shown in FIG. 5. The internal left hand threaded portion is of a size to receive a left hand threaded base of a light bulb, such as bulb 31 shown in FIG. 5. The size relationships of portions 102 and 103 can vary to accommodate different size sockets and light bulbs.

As shown in FIG. 8, the portion 102 has external right hand threads 104 and an internal cylindrical wall 106. Wall 106 surrounds an annular chamber 107. Portion 102 has an end wall 108 closing one end of the tubular member 101. Wall 108 carries an inwardly directed base or tubular sleeve 109. Sleeve 109 extends longitudinally into chamber 107 and has a longitudinal passage 111. A rod 112 of electrically conductive material is disposed in passage 111. Rod 112 has an external head 113 located over an outside portion of end wall 108 and an internal head 114 located in chamber 107. A U-shaped electrical conductor member 115 is attached to rod 112 with head 114. The rod 112 and its heads 113 and 114 and member 115 provide an electrical conductor connecting the center conductor of the bulb with the center conductor of the socket.

Body portion 102 is integrally connected with portion 103 with an annular outwardly directed shoulder 116. Body portion 103 has interior threads 117 surrounding a cavity or chamber 118. Chamber 118 is adapted to accommodate the base of the light bulb when the base is threaded onto threads 117. The entrance end of portion 103 has an inwardly directed annular beveled edge 119 for guiding the base of the bulb into the threads 117. Beveled edge 119 surrounds a circular opening 121 providing an entrance to chamber 118. An outwardly directed cylindrical boss 122 is integral with an outer portion of portion 103.

An electrical contact 123 is provided between body portions 102 and 103. Contact 123 is a metal strip or elongated metal member, preferably copper or copper alloy, and is used to provide an electrical connection between the socket and the base of the bulb. Strip 123 is located in a first groove 124 in the inside of portion 103 and a second groove 126 located in an external part of portion 102. An opening 125 in shoulder 116 connects grooves 124 and 126. The threads of the socket bias strip 123 into groove 126 thereby making electrical contact with the socket. When the bulb is turned into cavity 118, it engages strip 123 and urges the strip outward into groove 124. Thus, the strip 123 is biased into firm electrical contact with both the side of the socket and the side of the bulb.

Figure 11:
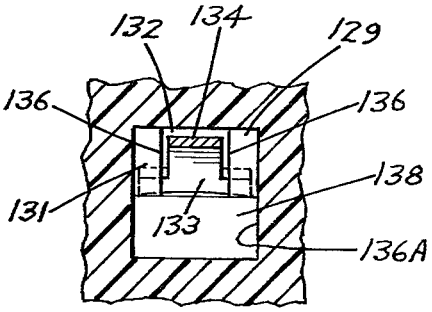
FIG. 11 is a sectional view taken along line 11—11 of FIG. 10.
Figure 10:
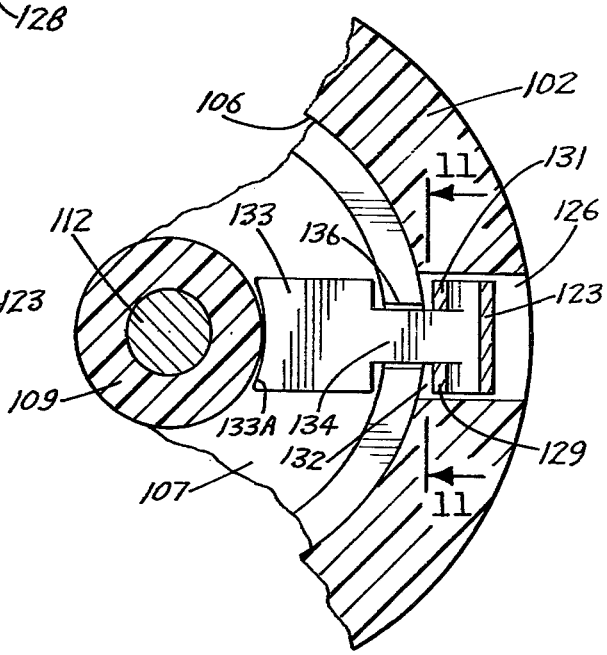
FIG. 10 is an enlarged sectional view taken along line 10—10 of FIG. 8.

Strip 123 has an outwardly reverse turned end 127 that extends into a pocket 128 in body portion 103. The end 127 holds strip 123 in the groove 124. As shown in FIG. 10, the opposite or forward end of strip 123 has a pair of reverse turned projections 129 and 131 located in a recess 132. Recess 132 is open to groove 126. The forward end of strip 123 has a tab 133 connected to a narrow neck 134. Neck 134 extends through an opening or passage 136 in the portion 102 so that the tab 133 is located in the bottom of the chamber 107. Tab 133 is substantially wider than neck 134 and engages the wall 106 and sleeve 109. The outer end of tab 133 has an arcuate shape 133A to provide a locking engagement with the sleeve 109. Tab 133 holds the strip 123 in the groove 126. As shown in FIG. 11, the opening 136 has an enlarged upper portion 136A to permit the tab 133 to be inserted into and through portion 102 into chamber 107. The tab 133 and neck 136 are bent downwardly to locate the neck 134 in the narrow passage 136.

Figure 9:
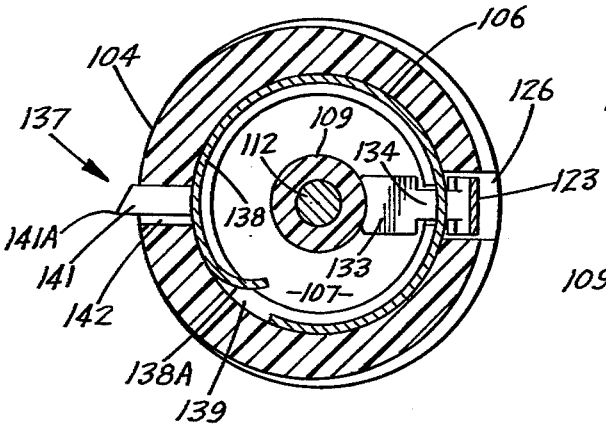
FIG. 9 is a sectional view taken along line 9—9 of FIG. 8.

Referring to FIGS. 8 and 9, the adapter 100 has a releasable locking structure indicated generally at 137 for locking the adapter to the electrical socket. The locking structure 137 comprises an arcuate split band spring 138 located in the passage 107. The spring 138 engages the inside wall 106 and is of resilient metal which biases the spring into firm engagement with wall 106. Spring 138 has an inwardly turned end 138A forming a mouth or entrance opening 139 between spring end 138A and wall 106. A radially outwardly directed locking finger 141 is attached to spring 138 adjacent end 138A. Finger 141 projects through an opening or hole 142 in the body portion 102. Finger 141 terminates in a sharp edge 141A adapted to dig into the metal receiver of socket 10, thereby preventing the adapter from being removed from the socket. The finger 141 must be moved to a retracted position before the adapter can be removed from the socket. When finger 141 is located in hole 142, the band spring 138 engages a shoulder 143 in the body portion 102, as shown in FIG. 8. The band spring 138 also closes the upper opening 136A, thereby preventing the tab 133 and strip 123 from moving out of the groove 126.

Figure 12:
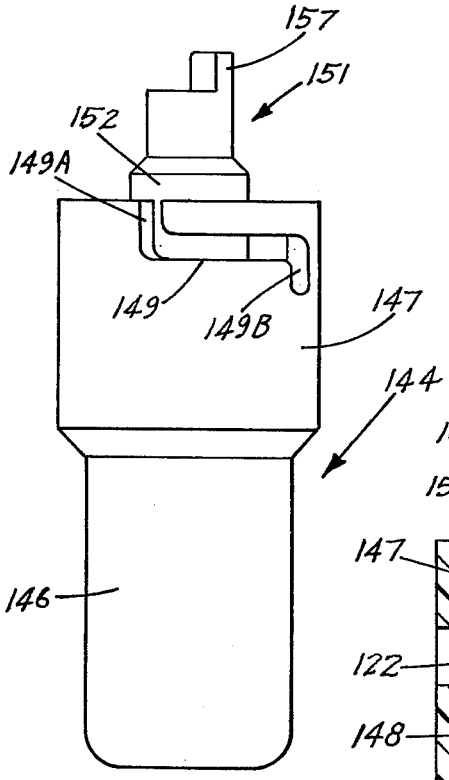
FIG. 12 is a side elevational view of an apparatus for mounting and demounting the adapter in a conventional light socket.

Referring to FIGS. 12–15 there is shown an adapter mounting and removing tool apparatus indicated generally at 144. The apparatus 144 is used to release the locking structure 137 so that the adapter 100 can be turned into the socket and out of the socket. Apparatus 144 has a casing 146 of electrically insulative material, preferably a plastic material. Casing 146 has an enlarged end having an annular cylindrical flange 147. Flange 147 surrounds a chamber 148 having an open end. As shown in FIG. 12, flange 147 has a generally Z-shaped slot or opening 149. Slot 149 has an axial entrance portion 149A and an axial inwardly directed terminal or end portion 149B. Slot 149 extends in a circumferential direction between the entrance portion 149A and terminal or end portion 149B.

A tool 151 is mounted on the casing 146. The tool 151 has a body 152 located in passage 148. The body 152 has a downwardly directed longitudinal tail or end 153 located in a bore 154 in casing 146. The end 153 is in tight frictional engagement with the casing 146 to securely mount the tool 151 on casing 146.

Figure 13:
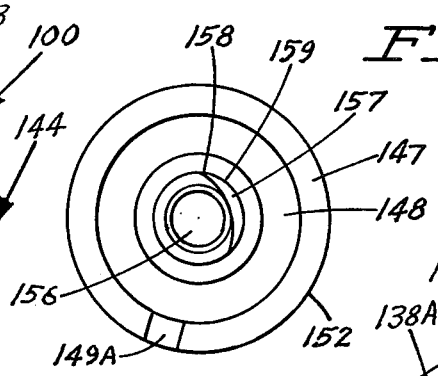
FIG. 13 is a top plan view of the apparatus of FIG. 12.
Figure 16:
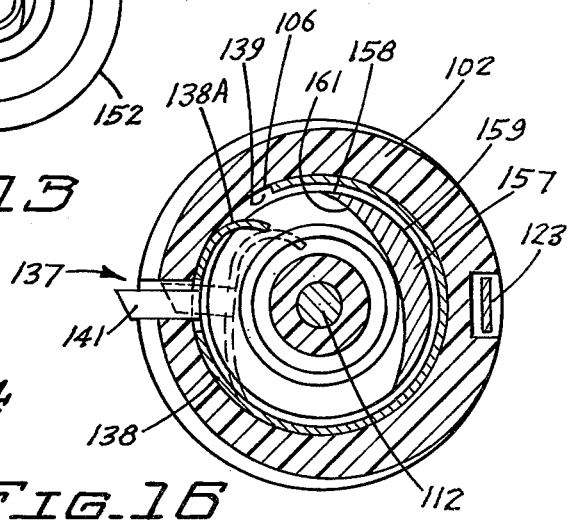
FIG. 16 is a sectional view taken along line 16—16 of FIG. 15.

Body 152 carries a cylindrical sleeve 155 of electrically insulative material forming an axial passage 156 for accommodating the sleeve 109 and contact member 115 of the adapter. An arcuate or half-moon shaped lip 157 is mounted on the outer end of body 152. Lip 157 has a leading or forward edge 158. As shown in FIGS. 13 and 16, lip 157 has a circular outer surface 159 and an arcuate inner surface 161 providing the lip with an arcuate tapered configuration which progressively moves closer to the central longitudinal axis of the tool.

Figure 15:
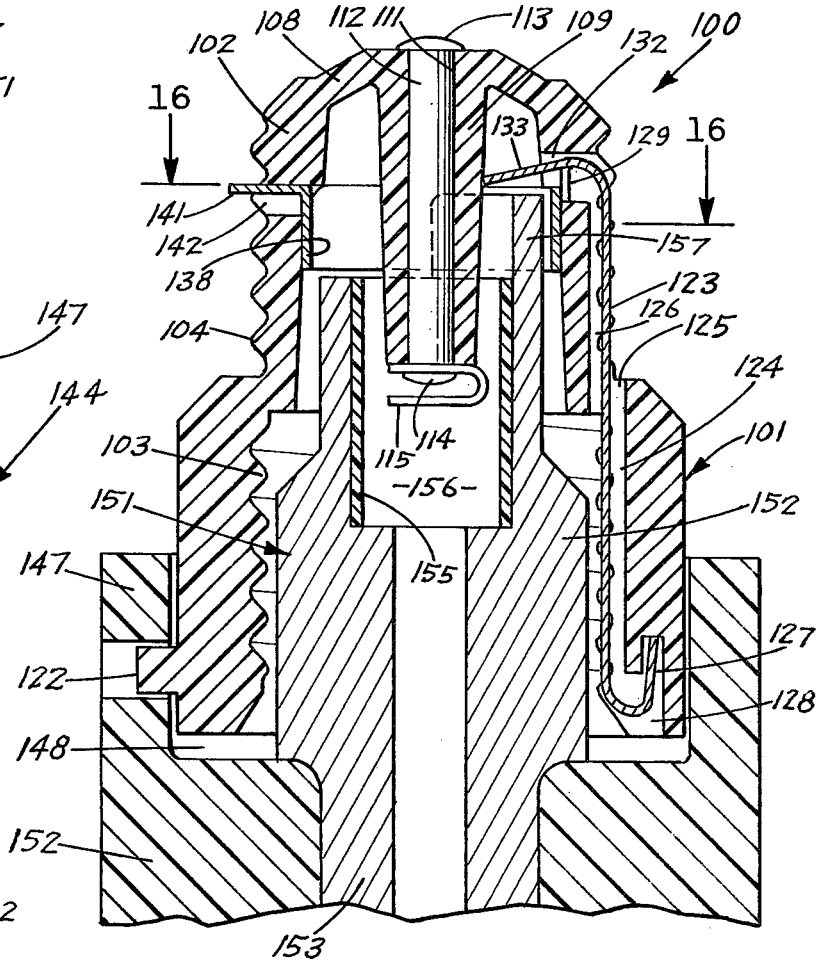
FIG. 15 is an enlarged sectional view taken along line 15—15 of FIG. 13.
Figure 14:
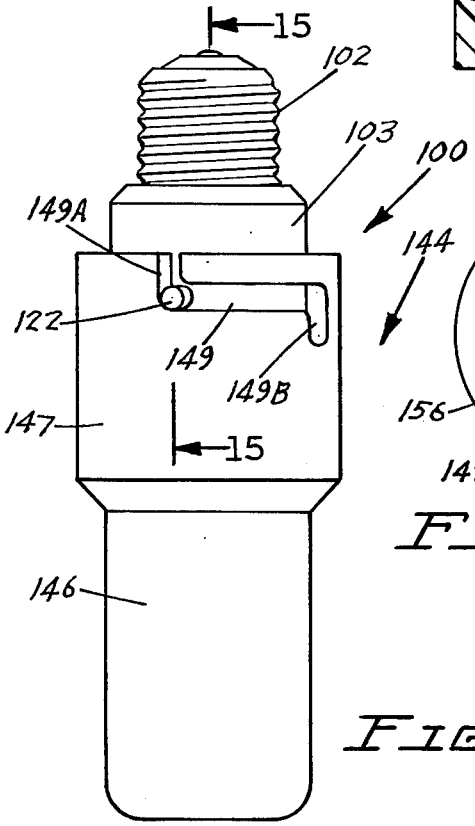
FIG. 14 is a side elevation view of the apparatus of FIG. 12 in assembled relation with an adapter.

As shown in FIG. 14, the adapter 100 is mounted on tool apparatus 144 by locating the body portion 103 in the chamber 148. The boss 122 is located in the entrance channel section 149A. When the boss 122 is located in the bottom of channel portion 149A, the lip 157 is located in a concentric position relative to the band spring 138, as shown in FIG. 15. The forward or leading edge of lip 157 is located adjacent the mouth 139. The boss 122, being positioned in the entrance section 149A of the groove, locates edge 158 adjacent the mouth 139.

The adapter 100 is rotated relative to the tool apparatus 144, moving the boss 122 along groove 149. This rotation moves the lip 157 into the mouth 139. The arcuate inner surface 161 of lip 157 engages the band spring end 138A, moving the spring in an inward direction and thereby retracting locking finger 141 into the body portion 102, as shown in broken lines in FIG. 15. Continued rotation of the tool apparatus 144 will turn the adapter to remove the adapter from the socket. The finger 141, being retracted into the body portion 102, does not interfere with the removal of the adapter from the socket.

The mounting and removing tool 144 is also used to turn the electrical adapter into the socket. The adapter 100 is placed on the apparatus 144. The boss 122 is located in the terminal groove 149B, as shown in broken lines in FIG. 14. This locates the lip 157 behind the spring end section 138A holding the locking finger 141 in a retracted position, as shown in broken lines in FIG. 16. The boss 122, being located in the groove portion 149B, can be rotated in a counterclockwise direction until the right hand threaded portion can be threaded into the socket. When the adapter is threaded into the socket, the casing 146 is moved longitudinally in an outward direction so that the boss 122 is in alignment with the channel 149. The casing 146 is then rotated to align the boss 122 with the entrance portion of channel 149A so that the entire tool apparatus can be removed from the adapter. During the rotation of the casing 146, the lip 157 moves out of the mouth 139. The band spring 138 forces the locking finger 141 into engagement with the threaded tube of the socket, thereby locking the adapter 100 in the socket.

This structure and the method of utilizing it as aforesaid discourage or deter stealing of bulbs for at least two reasons. When a person attempts to remove the bulb in the conventional manner, it tends to screw tighter into the adapter and since the adapter is locked in the socket, it gives the impression that the bulb is stuck in the socket. If the person becomes aware that the bulb can be removed by turning it in the reverse direction, he still cannot readily use the bulb since he must have an adapter and it cannot be removed. The effect is to discourage stealing the bulbs.

The foregoing description is of preferred embodiments of the invention. Various changes may be made in materials, size, form and details without departing from the invention. For example, the locking structure 137 can be used with an adapter having right hand internal and external threads or left hand internal and external threads. Also, the electrical contact strips 123 and grooves therefor in the body can be used in adapters having right hand internal and external threads or left hand internal and external threads.

The embodiments of the invention in which an exclusive property or privilege is claimed are defined as follows:

1. An adapter for electrically connecting an electric light socket having an internal threaded electrically conductive portion to a light bulb having an electrically conductive external sleeve provided with external threads, the adapter comprising: a tubular member having a threaded first end section adapted to mate with the threaded electrically conductive portion of the socket and a second end section having an internal threaded wall forming a cavity for accommodating the threaded sleeve of the light bulb, first electrical conductor means extended between the first end section and engageable with a portion of the socket and the second end sections and the socket and sleeve of the bulb, said first section having an externally open groove, said second section having an internally open groove, said first electrical conductor means comprising an elongated electrically conductive member located in said first and second grooves, and second electrically conductive means insulatively mounted on the tubular member adapted to contact the center of the base of the bulb and the center of the socket, and means for locking adapter in a socket, said means for locking the adapter in the socket comprising a band spring located within the tubular member, and locking finger means cooperating with the spring whereby the spring biases the finger locking means to a locking position, said first end section of the tubular member having a hole for accommodating said locking finger means.

2. The adapter of claim 1 wherein: the first end section has right hand threads and the internal threaded wall has left hand threads.

3. The adapter of claim 1 wherein: the elongated electrically conductive member has a reverse turned end located in a pocket in the tubular member.

4. The adapter of claim 1 wherein: the elongated member has means extended through a hole in the tubular member to hold the elongated member in the grooves.

5. The adapter of claim 1 wherein: the spring has an inwardly projected portion adapted to be engaged by releasing tool means operable to move the spring and retract the locking finger means to a non-locking position.

6. An adapter for electrically connecting an electric light socket having an internal threaded electrically conductive portion to a light bulb having an electrically conductive external sleeve provided with external threads, the adapter comprising: an electrically insulative tubular member having a threaded first end section adapted to mate with a threaded electrically conductive portion of a socket and a second end section having an internal threaded wall forming a cavity for accommodating the threaded sleeve of a light bulb, the end sections disposed about a common central axis, an elongated electrically conductive member extended between the first end section and the second end sections and engageable with the threaded sleeve and the threaded portion of the socket, electrically conductive means insulatively mounted on the tubular member adapted to contact the center of the base of the bulb and the center of the socket, the socket and first end section when threadably engaged, engaging one end portion of the electrically conductive member to bias an opposing end portion of said member toward contact with the threaded sleeve when said sleeve is threadably engaged with the second end section, and means for locking the adapter in a socket separated from the electrically conductive member and conductive means, said means for locking the adapter in a socket comprising a band spring located within the tubular member, and locking means cooperating with the spring whereby the spring biases the locking means to a locking position, said first end section of the tubular member having a hole for accommodating said locking means.

7. The adapter of claim 6 including: an externally open groove in the first end section and an internally open groove in the second end section, with said elongated electrically conductive member located in the first and second grooves.

8. The adapter of claim 7 wherein: the grooves are parallel to the central axis and substantially linearly aligned.

9. The adapter of claim 6 wherein: the tubular member is unitary and electrically insulative.

10. The adapter of claim 6 wherein: the first end section has right hand threads and the internal threaded wall has left hand threads.

11. The adapter of claim 6 wherein: the electrically conductive member is a resilient metal strip.

* * * * *